US009666068B2

(12) United States Patent
Fleming

(10) Patent No.: US 9,666,068 B2
(45) Date of Patent: May 30, 2017

(54) SYNCHRONIZED TRAFFIC WARNING SIGNAL SYSTEM

(71) Applicant: INTERNATIONAL BUSINESS MACHINES CORPORATION, Armonk, NY (US)

(72) Inventor: Mark S. Fleming, Oro Valley, AZ (US)

(73) Assignee: INTERNATIONAL BUSINESS MACHINES CORPORATION, Armonk, NY (US)

( * ) Notice: Subject to any disclaimer, the term of this patent is extended or adjusted under 35 U.S.C. 154(b) by 2 days.

(21) Appl. No.: 14/658,467

(22) Filed: Mar. 16, 2015

(65) Prior Publication Data

US 2016/0275791 A1 Sep. 22, 2016

(51) Int. Cl.

| | |
|---|---|
| ***G08G 1/095*** | (2006.01) |
| ***E01F 9/529*** | (2016.01) |
| ***E01F 9/559*** | (2016.01) |

(52) U.S. Cl.

CPC ..... *G08G 1/095* (2013.01); *E01F 9/529* (2016.02); *E01F 9/559* (2016.02)

(58) Field of Classification Search

CPC ..... G08G 1/095; G08G 1/096; G08G 1/087; G08G 1/67; G08G 1/005; G08G 1/081; G08G 1/0104; E01F 9/529; E01F 9/512; E01F 9/604; E01F 9/553

USPC .... 340/906, 907, 909, 539.1, 929, 944, 332; 362/145, 243, 153.1, 555, 153; 404/16, 404/12, 15, 17, 22, 84.05

See application file for complete search history.

(56) References Cited

U.S. PATENT DOCUMENTS

| | | | | |
|---|---|---|---|---|
| 4,145,112 A * | 3/1979 | Crone | G02B 5/124 | 359/531 |
| 4,236,950 A * | 12/1980 | Eigenmann | E01C 23/185 | 118/305 |
| 4,847,618 A * | 7/1989 | Baustin | G08G 1/096 | 116/63 R |
| 5,278,554 A * | 1/1994 | Marton | G08G 1/081 | 340/909 |
| 5,501,545 A * | 3/1996 | Walter | G02B 5/124 | 359/531 |
| 5,515,807 A * | 5/1996 | Speer | E01F 9/553 | 116/63 R |
| 5,673,039 A * | 9/1997 | Pietzsch | G08G 1/015 | 340/332 |
| 5,774,569 A * | 6/1998 | Waldenmaier | G06K 9/00771 | 348/143 |
| 5,778,332 A * | 7/1998 | Chang | G08G 1/0104 | 701/117 |

(Continued)

FOREIGN PATENT DOCUMENTS

CN 202787121 U 3/2013

OTHER PUBLICATIONS

Moore, A.F., "Evaluation of Experimental Rumble Strips", 26 pages, National Technical Information Service, 1987.

*Primary Examiner* — Hoi Lau

(74) *Attorney, Agent, or Firm* — Griffiths & Seaton PLLC

(57) ABSTRACT

A traffic warning signal system includes a substrate, and at least one light-emitting device embedded into the substrate and placed in proximity to a traffic signal such as to be visible upon approach to the traffic signal, such as the at least one light-emitting device is synchronized in at least one of a timing, a color, or a frequency with the traffic signal.

18 Claims, 7 Drawing Sheets

(56) References Cited

U.S. PATENT DOCUMENTS 6,310,562 B1 * 10/2001 Safronov ..... G08G 1/096 340/309.4
6,354,714 B1 * 3/2002 Rhodes ..... F21S 4/24 362/145
6,384,742 B1 * 5/2002 Harrison ..... B61L 29/24 340/917
6,398,399 B1 * 6/2002 Neophytou ..... G02B 6/001 362/153.1
6,547,484 B2 4/2003 Murphy
6,552,668 B1 * 4/2003 Berezovsky ..... G08G 1/096 340/907
6,597,293 B1 * 7/2003 Harrison ..... B61L 29/24 340/944
6,652,184 B1 * 11/2003 Knafelc ..... E01D 15/14 404/35
7,429,919 B2 * 9/2008 Silic ..... G08G 1/005 340/539.1
7,573,401 B2 8/2009 Wabeke
8,000,897 B2 8/2011 Breed et al.
9,111,445 B1 * 8/2015 Pashel ..... G08G 1/087
2002/0030992 A1 * 3/2002 Lefebvre ..... F21K 9/00 362/243
2002/0085390 A1 * 7/2002 Kiyomoto ..... B60Q 1/302 362/555
2004/0130463 A1 * 7/2004 Bloomquist ..... G08G 1/096716 340/907
2005/0084329 A1 * 4/2005 Myers ..... G09F 19/22 404/72
2005/0128105 A1 * 6/2005 Green ..... B29C 39/10 340/944
2005/0156757 A1 * 7/2005 Garner ..... G08G 1/097 340/907
2005/0187701 A1 * 8/2005 Baney ..... G08G 1/096716 701/117
2005/0270175 A1 * 12/2005 Peddie ..... G08G 1/096783 340/907
2006/0028808 A1 * 2/2006 Clanton ..... E01F 15/083 362/153
2006/0181433 A1 * 8/2006 Wolterman ..... G08G 1/164 340/917
2007/0001872 A1 * 1/2007 Ellison ..... G08G 1/0965 340/907
2007/0070618 A1 * 3/2007 Talamo ..... E01F 9/002 362/153.1
2007/0200730 A1 * 8/2007 Kang ..... G08G 1/095 340/907
2008/0094249 A1 * 4/2008 Pappas ..... G08G 1/087 340/906
2008/0246630 A1 * 10/2008 Rosemeyer ..... E01F 9/065 340/907
2008/0260458 A1 * 10/2008 Fillie ..... E01F 9/529 404/16
2009/0135024 A1 * 5/2009 Park ..... G08G 1/096 340/929
2009/0262522 A1 * 10/2009 Burns ..... 362/153.1
2010/0215431 A1 * 8/2010 Mettler ..... E01F 9/529 404/15
2012/0033076 A1 * 2/2012 Nakamura ..... B60W 10/06 348/148
2012/0098657 A1 * 4/2012 Bogatine ..... G08G 1/167 340/439
2013/0049990 A1 * 2/2013 Shi ..... G08G 1/095 340/907
2013/0049993 A1 * 2/2013 Shi ..... G08G 1/095 340/928
2013/0321173 A1 * 12/2013 Ni ..... G08G 1/07 340/907
2013/0321175 A1 * 12/2013 Kondo ..... G08G 1/005 340/944
2014/0097969 A1 * 4/2014 Ni ..... G08G 1/07 340/907
2014/0190395 A1 7/2014 Cowan
2015/0123817 A1 * 5/2015 Almalki ..... F03D 9/00 340/907
2015/0319829 A1 * 11/2015 Shu ..... H05B 37/034 702/184
2015/0376849 A1 * 12/2015 Thompson ..... E01F 9/604 404/15
2016/0258115 A1 * 9/2016 Penland, Jr. ..... B32B 15/095
2016/0275791 A1 * 9/2016 Fleming ..... G08G 1/095

* cited by examiner

SYNCHRONIZED TRAFFIC WARNING SIGNAL SYSTEM

BACKGROUND OF THE INVENTION

Field of the Invention

This disclosure relates in general to traffic control and traffic signal systems. More particularly, the present invention relates to various embodiments for a synchronized traffic warning signal system.

Description of the Related Art

Traffic signaling control systems are a matter of public safety. Traffic related accidents account for a vast majority of accident related injuries and fatalities each year, and as passenger traffic steadily increases, the coinciding risk of accident and injury escalates. As great strides and advances in technologies come to fruition, these traffic signaling systems have largely remained unchanged since their conception and implementation.

Accordingly, current advances in traffic, traffic signaling systems, and the greater understanding of traffic flow itself have made progress in these systems advantageous endeavors for efficiency and safety.

SUMMARY OF THE DESCRIBED EMBODIMENTS

A traffic warning signal system includes a substrate, and at least one light-emitting device embedded into the substrate and placed in proximity to a traffic signal such as to be visible upon approach to the traffic signal, such as the at least one light-emitting device is synchronized in at least one of a timing, a color, or a frequency with the traffic signal.

In addition to the foregoing exemplary embodiment, various other system and computer program product embodiments are provided and supply related advantages. The foregoing summary has been provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict embodiments of the invention and are not therefore to be considered to be limiting of its scope, the invention will be described and explained with additional specificity and detail through the use of the accompanying drawings, in which.

DETAILED DESCRIPTION OF THE DRAWINGS

Figure 1:
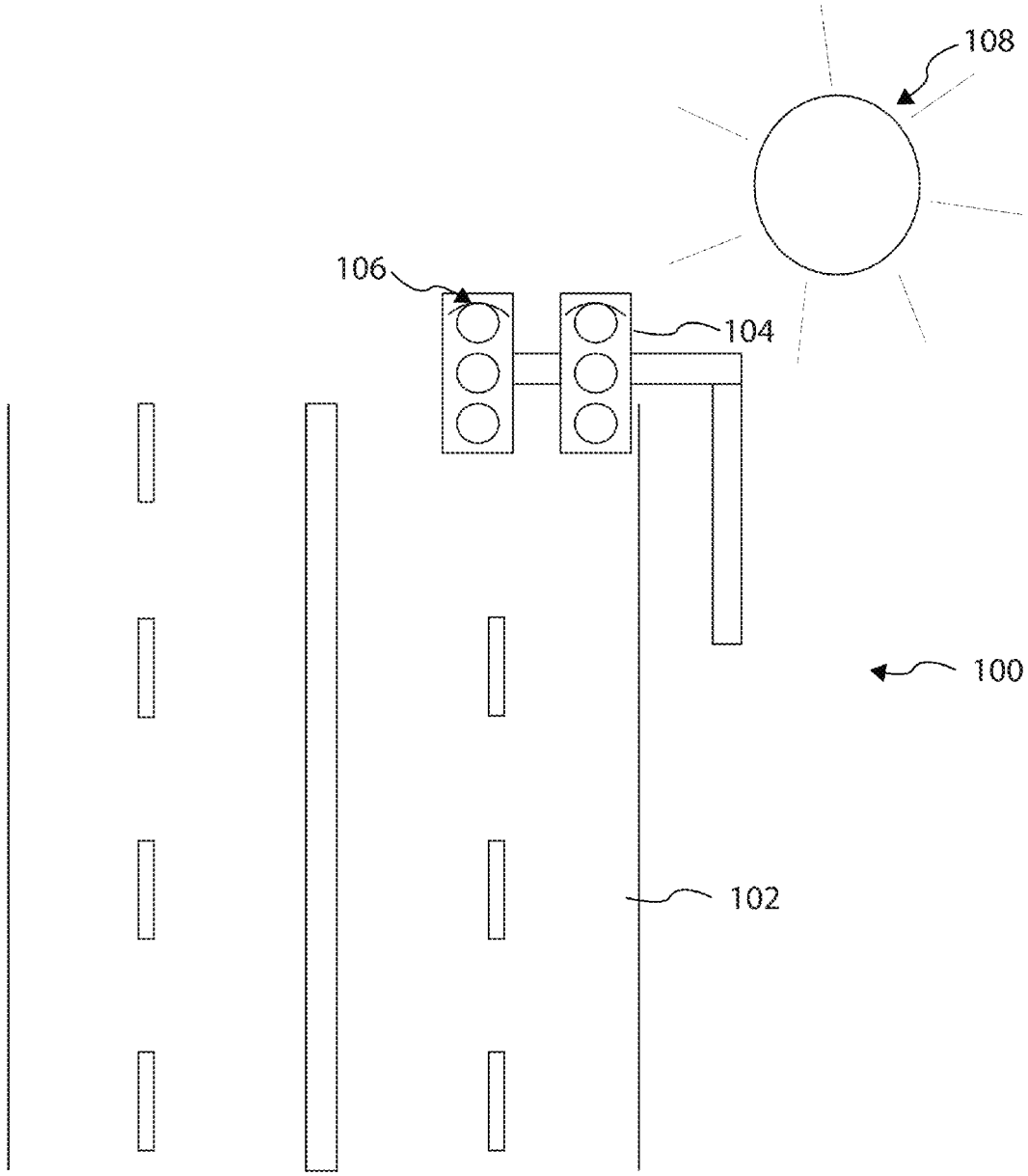
FIG. 1 PRIOR ART
FIG. 1 illustrates a perspective view of a prior art traffic signal system.

As aforementioned, traffic signaling control systems are a matter of public safety. Traffic related accidents account for a vast majority of accident related injuries and fatalities each year, and as passenger traffic steadily increases, the coinciding risk of accident and injury escalates. As great strides and advances in technologies come to fruition, these traffic signaling systems have largely remained unchanged since their conception and implementation.

More specifically, visibility of overhead traffic signaling systems is largely dependent upon a variety of factors. Some of these factors include the time of day (i.e. Sun interference), topology of the landscape, and the dynamics of the particular intersection itself.

Poor visibility of traffic signaling systems causes a number of complications. Aside from inefficient traffic flow, the lack of visibility of these signals is dangerous. A common complaint among drivers, especially drivers having engaged in an automobile accident is the inability to see the changing color of the traffic signal, with particular respect to the direction of travel and the direction of the sun.

Automobile makers have vaguely addressed this problem by the inclusion of visors in automobiles, trucks, buses, etc. The heart of the problem still however remains: a motorist must look (sometimes directly) into the sun filled sky to observe an overhead traffic signal.

Accordingly, the present invention considers a synchronized traffic warning signaling system. The system may be implemented in a variety of embodiments suited to the individual goals of the implementer. Reference in the description to "one embodiment" or "an embodiment" means that a particular feature, structure, or characteristic described in connection with the embodiment is included in at least one embodiment of the invention. The phrase "in one embodiment" located in various places in this description does not necessarily refer to the same embodiment.

In the following detailed description, for purposes of explanation, numerous specific details are set forth in order to provide a thorough understanding of the subject matter of the present application. It will be evident, however, to one skilled in the art that the disclosed embodiments, the claimed subject matter, and their equivalents may be practiced without these specific details.

The detailed description includes references to the accompanying drawings, which form a part of the detailed description. The drawings show illustrations in accordance with example embodiments. These embodiments, which may also be referred to herein as "examples," are described in enough detail to enable those skilled in the art to practice the embodiments of the claimed subject matter described herein. The embodiments may be combined, other embodiments may be utilized, or structural, logical, and electrical changes may be made without departing from the scope and spirit of the claimed subject matter. It should be understood that the embodiments described herein are not intended to limit the scope of the subject matter but rather to enable one skilled in the art to practice, make, and/or use the subject matter.

FIG. 1 illustrates a simple perspective view of a prior art traffic signaling system 100. A roadway 102 approaches an intersection with a traffic signal 104. Despite the traffic signal 104 having visors over each signal 106 to improve visibility, a motorist must still look upward toward the sky when approaching to engage the color of the traffic signal 104. The Sun, 108, particularly in morning and evening times, provides a reduced visibility glare to motorists who may not be able to see accurately the traffic signal 104 color. This is a remarkably common situation in which motorists may encounter a traffic accident.

Figure 2:
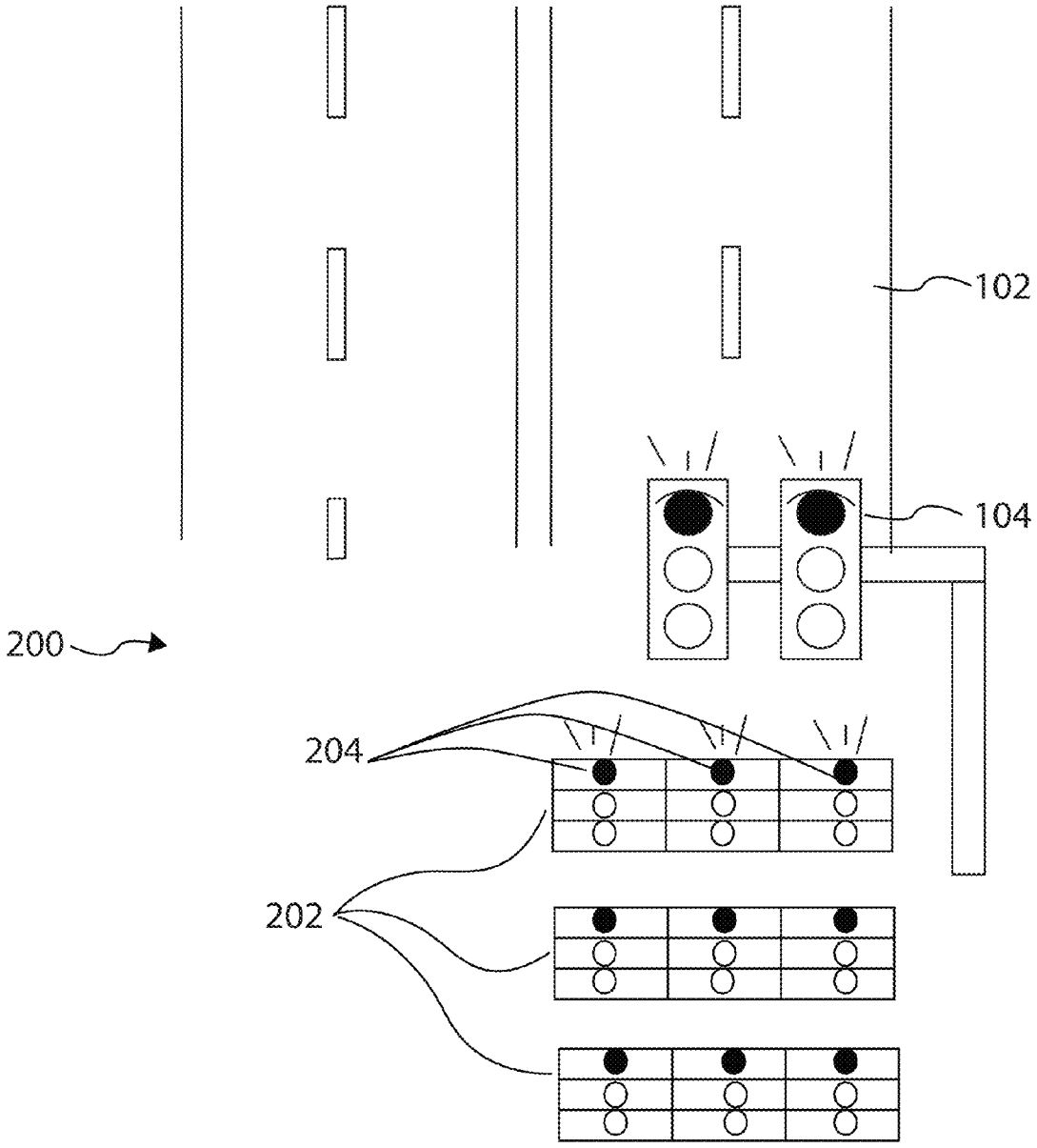
FIG. 2 illustrates a perspective view of a traffic signal system according to one aspect of the present invention.

The present invention discloses a method of embedding a light-emitting device into a roadway structure, the light-emitting device synchronized with an overhead traffic signal. FIG. 2 illustrates one embodiment of the present invention 200 in which the light-emitting device is embedded into a substrate structure 202 placed prior to the overhead traffic signal, and visible upon approach. In this manner, the roadway 102 and intersection with traffic signal 104 remain largely unchanged. The significant addition of a substrate 202 placed in pavement prior to the traffic signal 104, having embedded light-emitting devices 204 increases visibility exponentially. The light-emitting devices 204 are connected and synchronized to the traffic signal 104 to provide a synchronized color, timing, and frequency of the traffic signal 104.

Figure 3:
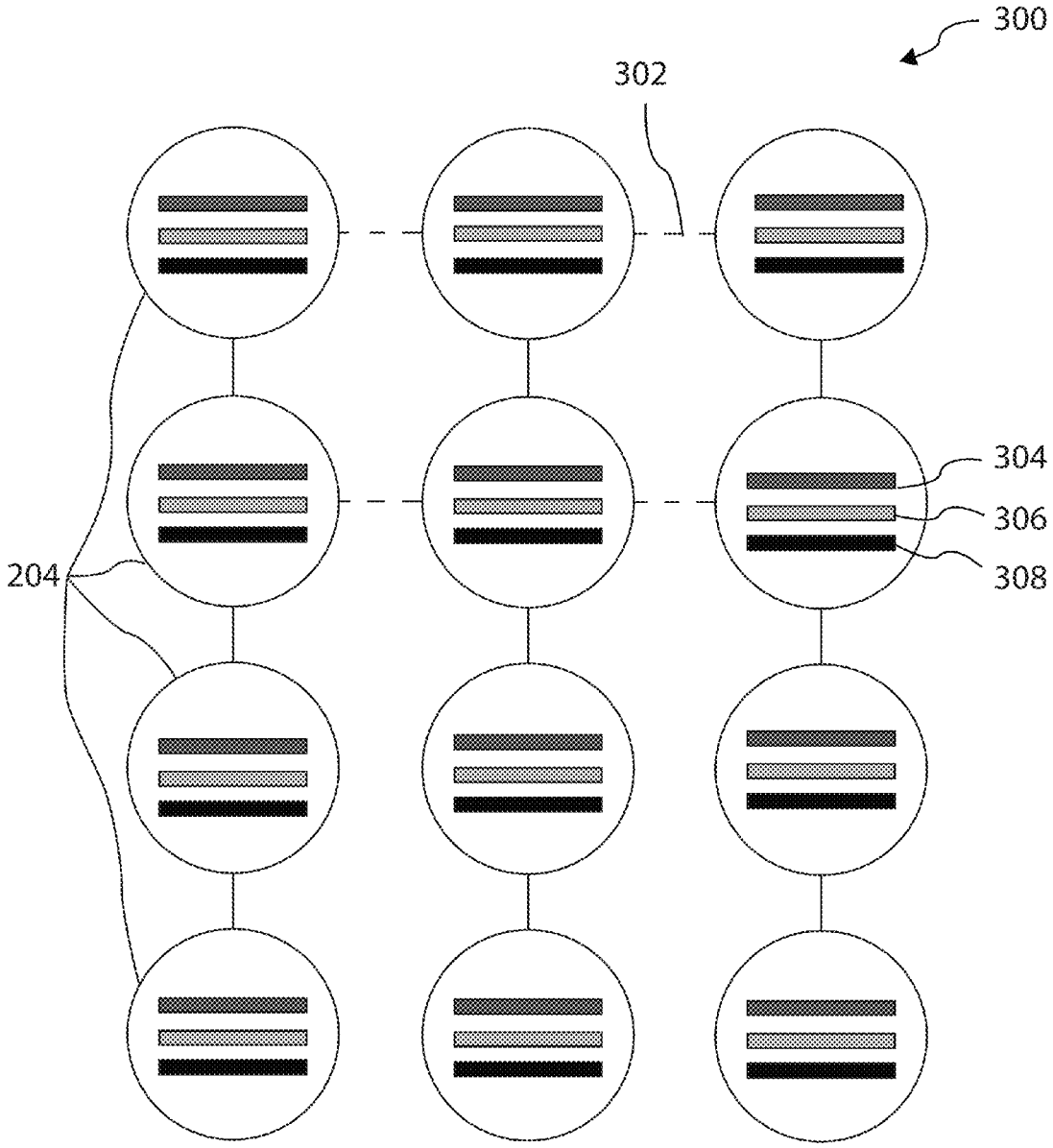
FIG. 3 illustrates an enlarged view of a traffic signal system according to one aspect of the present invention.

FIG. 3 illustrates an enlarged portion 300 of an interconnected system 302 of light-emitting devices 204. Each light-emitting device 204 may consist of multiple multi-colored lights. In this example, a plurality of light emitting diodes (LEDs) 304, 306, and 308 are placed in each light-emitting device 204 in an effort to achieve a synchronized color with the overhead traffic signal 104.

In one embodiment, the substrate may consist of a roadway pavement rumble strip structure. In another embodiment, the light-emitting device 204 may be embedded into the pavement itself with no rumble strip structure. The light-emitting devices 204 may be LEDs, incandescent light, fluorescent light, or any other device capable of outputting light. Similarly, the substrate structure 202 may be any structure capable of housing light-emitting devices 204.

As mentioned, substrate structure 202 may consist of roadway pavement rumble strips. In this manner, as a motorist approaches an intersection, the motorist achieves an "all-senses" indication of the upcoming intersection. More specifically, the motorist sees a synchronized representation of the overhead traffic signal 104 at eye-level upon approach. The motorist also receives an audible and vibratory response of the upcoming hazard.

In one embodiment, light-emitting devices 304, 306, and 308 may have separate and distinct colored lights corresponding to the synchronized traffic signal 102. In another embodiment, a multi-colored solution, lenses, or a device capable of producing each color of the corresponding traffic signal 102 may be used.

Figure 4:
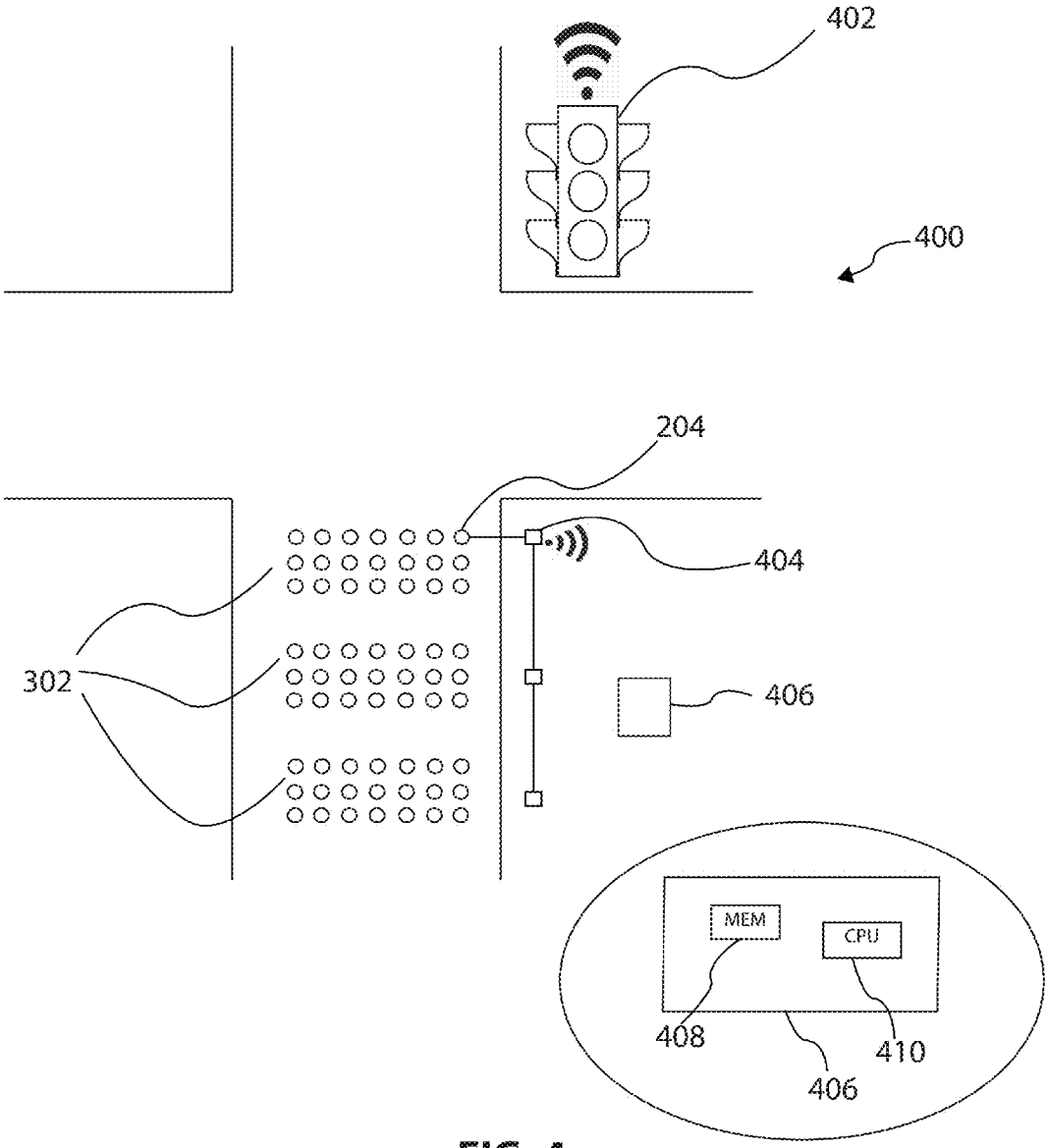
FIG. 4 illustrates an additional perspective view of a traffic signal system according to one aspect of the present invention.

FIG. 4 illustrates one embodiment of the present invention consisting of a wireless solution 400. In this example, multiple substrate structures 302 consisting of a plurality of embedded light-emitting devices 204 are interconnected wirelessly via a transceiver 404. A wireless communicative traffic light 402 may be connected to the substrate 302 via transceiver 404 and to a central traffic control signaling system 406. Central traffic signaling control system 406 may consist of a computerized system containing memory 408 and a central processing unit (CPU) 410, in which instructions for providing a synchronized traffic signaling system may be executed upon. The memory 408 may include hard disk drive (HDD) devices, solid-state devices (SSD), flash memory etc. Memory 408 may include such memory as electrically erasable programmable read only memory (EEPROM) or a host of related devices. Memory 408 may be connected to CPU 406 via a signal-bearing medium. In another embodiment, substrate structures 302 containing embedded light-emitting devices 204 are connected to a traffic signal 104 via hard wire.

Figure 5:
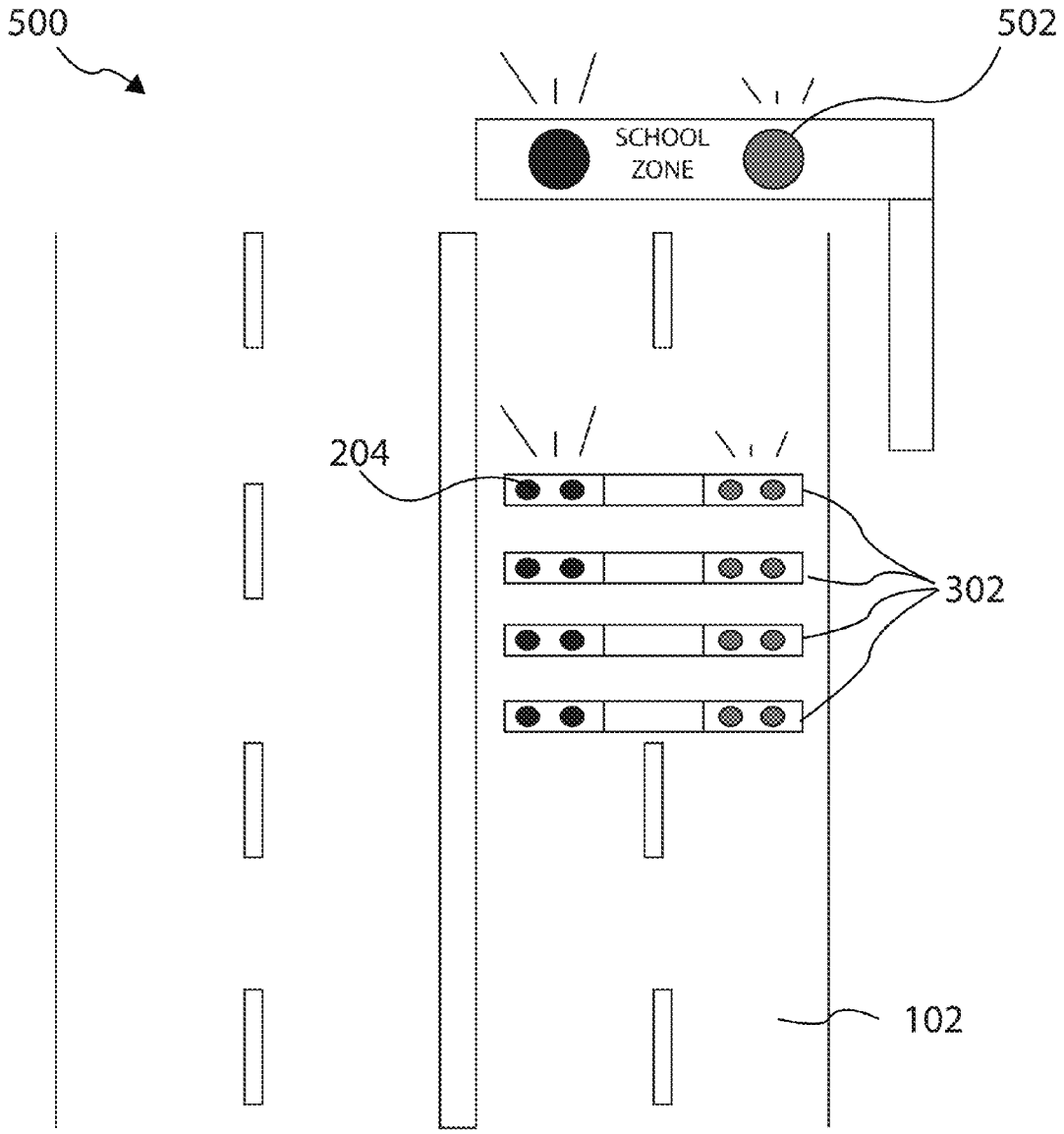
FIG. 5 illustrates still an additional perspective view of a traffic signal system according to one aspect of the present invention.

FIG. 5 illustrates an alternate embodiment of the present invention 500. In this example, roadway 102 travels through a school-zone having a school-zone traffic light signaling system 502. Substrate structures 302 house light-emitting devices 204 which are synchronized to school-zone traffic signaling system 502. In this way, light-emitting devices 204 show a roadway representation of traffic signal 502 in color, timing, and frequency.

Figure 6:
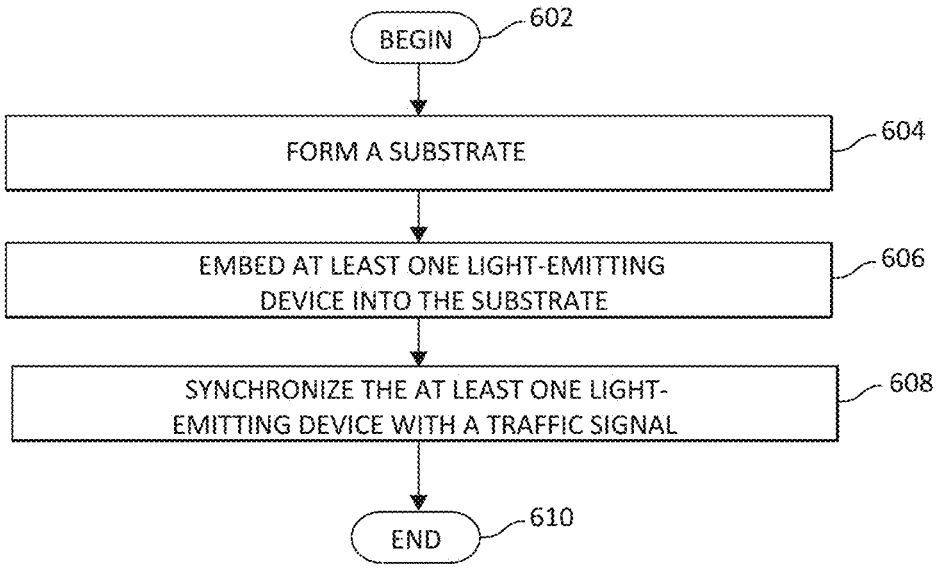
FIG. 6 illustrates a flow chart according to one aspect of the present invention.

FIG. 6 illustrates a flow chart according to one aspect of the present invention. Beginning at 602, a substrate is formed 604. At least one light-emitting device is then embedded into the substrate 606. The at least one light-emitting device is synchronized with a traffic signal 608, and the method ends at 610.

Figure 7:
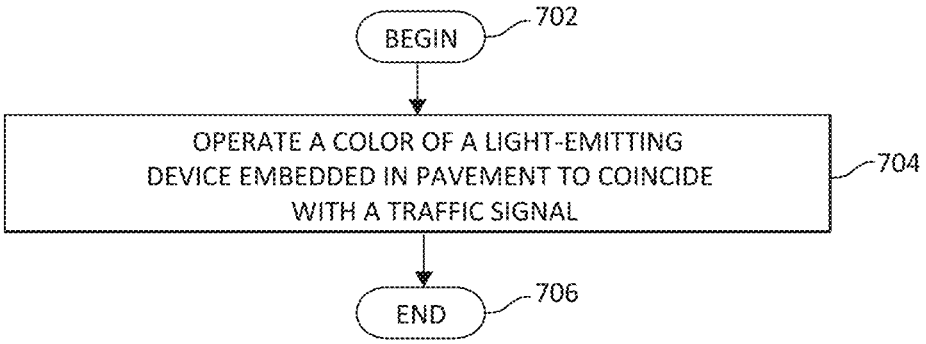
FIG. 7 illustrates an additional flow chart according to one aspect of the present invention.

FIG. 7 illustrates an additional flow chart according to one aspect of the present invention. Beginning at 702, a color of a light-emitting device embedded in pavement is operated to coincide with a traffic signal 704. The method ends 706.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a wave-guide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While one or more embodiments of the present invention have been illustrated in detail, one of ordinary skill in the art will appreciate that modifications and adaptations to those embodiments may be made without departing from the scope of the present invention as set forth in the following claims.

What is claimed is:

1. A traffic warning signal system, comprising:

a substrate;

at least one light-emitting device embedded into the substrate; wherein the at least one light-emitting device is synchronized with a traffic signal; and a roadway rumble strip structure containing the substrate and disposed within a roadway pavement at a plurality of intervals leading up to the traffic signal in a direction of travel; wherein an approaching motorist to the traffic signal receives a visual warning of a state of the traffic signal by viewing the light-emitting device upon approach, and a vibratory and audible warning of the traffic signal when traveling over the roadway rumble strip structure.

2. The traffic warning signal system of claim 1, wherein the light-emitting device is a light emitting diode (LED) device.

3. The traffic warning signal system of claim 1, wherein the light-emitting device is integrated into the substrate.

4. The traffic warning signal system of claim 1, further including a transceiver connected to the light-emitting device for providing wireless communication between the light-emitting device and the traffic signal.

5. The traffic warning signal system of claim 4, further including a hard wire connection to the light-emitting device for providing communication between the light-emitting device and the traffic signal.

6. The traffic warning signal system of claim 1, wherein the light-emitting device is capable of producing a plurality of colors.

7. A traffic warning signal system, comprising:

a substrate;

at least one light-emitting device embedded into the substrate and placed in proximity to a traffic signal thereby visible upon approach to the traffic signal; wherein the at least one light-emitting device is synchronized in at least one of a timing, a color, or a frequency with the traffic signal; and a roadway rumble strip structure containing the substrate and disposed within a roadway pavement at a plurality of intervals leading up to the traffic signal in a direction of travel; wherein an approaching motorist to the traffic signal receives a visual warning of a state of the traffic signal by viewing the light-emitting device upon approach, and a vibratory and audible warning of the traffic signal when traveling over the roadway rumble strip structure.

8. The traffic warning signal system of claim 7, wherein the light-emitting device is a light emitting diode (LED) device.

9. The traffic warning signal system of claim 7, wherein the light-emitting device is integrated into the substrate.

10. The traffic warning signal system of claim 7, further including a transceiver connected to the light-emitting device for providing wireless communication between the light-emitting device and the traffic signal.

11. The traffic warning signal system of claim 10, further including a hard wire connection to the light-emitting device for providing communication between the light-emitting device and the traffic signal.

12. The traffic warning signal system of claim 7, wherein the light-emitting device is capable of producing a plurality of colors.

13. A method of manufacturing a traffic warning signal system, comprising:

forming a substrate;

embedding at least one light-emitting device into the substrate; wherein the at least one light-emitting device is synchronized with a traffic signal; and forming a roadway rumble strip structure containing the substrate and disposed within a roadway pavement signal at a plurality of intervals leading up to the traffic signal in a direction of travel; wherein an approaching motorist to the traffic signal receives a visual warning of a state of the traffic signal by viewing the light-emitting device upon approach, and a vibratory and audible warning of the traffic signal when traveling over the roadway rumble strip structure.

14. The method of claim 13, wherein the light-emitting device is a light emitting diode (LED) device.

15. The method of claim 13, wherein the light-emitting device is integrated into the substrate.

16. The method of claim 13, further including a transceiver connected to the light-emitting device for providing wireless communication between the light-emitting device and the traffic signal.

17. The method of claim 16, further including a hard wire connection to the light-emitting device for providing communication between the light-emitting device and the traffic signal.

18. The method of claim 13, wherein the light-emitting device is capable of producing a plurality of colors.

* * * * *